US007852015B1

(12) United States Patent
Yen et al.

(10) Patent No.: US 7,852,015 B1
(45) Date of Patent: Dec. 14, 2010

(54) SOLID STATE LIGHTING SYSTEM AND MAINTENANCE METHOD THEREIN

(75) Inventors: Jui-Kang Yen, Taipei (TW); Trung Tri Doan, Baoshan Township (TW); Yung-Wei Chen, Taichung (TW); Ching-Tai Cheng, Hsinchu (TW)

(73) Assignee: SemiLEDS Optoelectronics Co., Ltd., Chu-Nan (TW)

( * ) Notice: Subject to any disclaimer, the term of this patent is extended or adjusted under 35 U.S.C. 154(b) by 907 days.

(21) Appl. No.: 11/548,604

(22) Filed: Oct. 11, 2006

(51) Int. Cl.
*H05B 41/16* (2006.01)

(52) U.S. Cl. ..... 315/291; 361/748; 257/97; 257/98

(58) Field of Classification Search ..... 257/97–99, 257/81, 79, 84; 361/736, 748, 768, 772; 315/291
See application file for complete search history.

(56) References Cited

U.S. PATENT DOCUMENTS 4,212,021 A * 7/1980 Ono et al. ..... 257/94
RE34,254 E * 5/1993 Dragoon ..... 362/307
5,299,096 A * 3/1994 Ishimatsu ..... 361/807
5,504,660 A * 4/1996 Heidorn ..... 362/27
5,515,468 A * 5/1996 DeAndrea et al. ..... 385/88
6,201,689 B1 * 3/2001 Miyasyo ..... 361/679.54
6,365,920 B1 * 4/2002 Abramov et al. ..... 257/81
6,623,152 B1 * 9/2003 Kroening ..... 362/555
7,166,868 B2 * 1/2007 Wu ..... 257/81
7,198,387 B1 * 4/2007 Gloisten et al. ..... 362/294
7,300,182 B2 * 11/2007 Mazzochette ..... 362/294
7,375,381 B2 * 5/2008 Shimizu et al. ..... 257/98
7,453,700 B2 * 11/2008 Miyata ..... 361/749
2010/0001658 A1 * 1/2010 Lee ..... 315/291

* cited by examiner

*Primary Examiner*—Anabel M Ton
(74) *Attorney, Agent, or Firm*—Patterson & Sheridan, L.L.P.

(57) ABSTRACT

A solid state light module incorporating light emitting diodes (LEDs) disposed on a metal substrate, a solid state lighting system employing such modules, and method of replacing LEDs of the light modules are provided. The metal substrate may allow for lower LED junction temperature and, hence, a longer device lifetime. In addition, the metal substrate may allow for the potential omission of a heat sink, which may reduce light module size, when compared to conventional solid state light emitters.

28 Claims, 12 Drawing Sheets

SOLID STATE LIGHTING SYSTEM AND MAINTENANCE METHOD THEREIN

BACKGROUND OF THE INVENTION

1. Field of the Invention

Embodiments of the present invention generally relate to solid state lighting systems and, more particularly, to interchangeable light modules having replaceable solid state light emitters.

2. Description of the Related Art

Advances in light-emitting diode (LED) luminous efficiency are allowing solid state emitters into numerous lighting applications that were previously unavailable. Solid state lighting is even replacing incandescent lighting technology in some applications where increased reliability is desired, especially in harsher environments where vibrations may occur (e.g., automobile taillights).

However, the lifetime of an LED is dependent on the junction temperature, and the junction temperature is proportional to forward current. To approach the luminous intensity of other lighting technologies, LEDs may need to operated at relatively high forward currents (e.g., in the hundreds of milliamps), thereby increasing the junction temperature. Since most LED semiconductor layers are formed on substrates of silicon, sapphire, or silicon carbide (SiC), the LEDs do not effectively conduct heat away from the LED die. To counteract this effect as shown in FIG. 1, a solid state emitter 100 may be mounted on a heat sink 102, typically by soldering the leads 104 of the emitter 100 to the heat sink 102. The heat sink 102 dissipates heat away from the LED die of the solid state emitter 100 and generally reduces the junction temperature of the LED die. Another example of this may be shown in the solid state light array 200 of FIG. 2, where several solid state light emitters 202 have been reflowed or soldered to a metal core printed circuit board (MCPCB) 204 functioning as a heat sink.

Large heat sinks may present problems for solid state light structures utilizing them. The benefit of increased heat dissipation from large heat sinks translates into higher soldering or reflow temperatures when the solid state light emitters need to be connected or disconnected from a mounting, such as a printed circuit board (PCB) or an MCPCB. These increased desoldering temperatures oftentimes hinder removal of a failed light emitter from a PCB in the field using a soldering iron and may lead to damage to the PCB during a light emitter replacement operation. Furthermore, a large heat sink may prevent a solid state light structure from entering an application where a smaller size is necessary. This problem is compounded when multiple solid state light emitters are necessary on a single light structure, and the spacing between light emitters is increased for proper heat dissipation capability of the heat sink (see FIG. 2).

Accordingly, what is needed is an improved solid state light structure for use in a solid state lighting system.

SUMMARY OF THE INVENTION

One embodiment of the invention provides a solid state light module. The light modules generally includes a printed circuit board (PCB), at least one light-emitting diode (LED), wherein the LED is coupled to the PCB via a solderless connection, and a first interface coupled to the PCB, for external connection with a power supply. Some embodiments of the light module provide a driving circuit configured to provide current to the at least one LED and coupled to the PCB.

Another embodiment of the invention provides a solid state lighting system. The lighting system generally includes a power supply coupled to one or more module interfaces; one or more solid state light modules, each module at least mechanically and electrically coupled to one of the module interfaces. Each of the solid state light modules generally includes a PCB, at least one LED, wherein the LED is coupled to the PCB via a solderless connection, and a first interface coupled to the PCB, for connection with one of the module interfaces.

Yet another embodiment of the invention provides a solid state lighting system. The lighting system generally includes a power supply and one or more solid state light modules. Each of the solid state light modules generally includes a light source PCB; at least one LED, wherein the LED is coupled to the light source PCB without solder; a circuit module coupled to the light source PCB via a first interface; a driving circuit disposed on the circuit module for providing current to the at least one LED; and a second interface disposed on the circuit module and coupling the power supply to the circuit module.

Yet another embodiment of the invention is a method of replacing a first LED in a solid state light module with a second LED. The method generally includes providing the solid state light module—which generally includes a PCB, a first interface coupled to the PCB, for external connection with a power supply, and the first LED, wherein the first LED is coupled to the PCB via a second interface configured such that leads of the first LED are at least electrically and mechanically coupled to the second interface without solder—applying a first mechanical force to remove the first LED from the second interface; providing the second LED; and applying a second mechanical force to install the second LED such that an electrical contact is made between the second interface and the second LED.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide solid state light modules incorporating light emitting diodes (LEDs) and a solid state lighting system employing such modules. For some embodiments, the LED comprises a semiconductor structure for emitting light coupled to a metal substrate. The metal substrate may allow for lower LED junction temperature and, hence, a longer device lifetime. In addition, the metal substrate may allow for the potential omission of a heat sink, which may reduce light module size, when compared to conventional solid state light emitters.

For some embodiments, the light modules may utilize an interface between the LEDs and the remainder of the module such that installation and removal of the LEDs may be accomplished by mechanical force rather than by soldering/desoldering the leads to make/break the electrical contact. For these embodiments, failed LEDs may be manually replaced quickly at or near room temperature without the risk of damage to the boards caused during the soldering process, especially when large heat sinks are involved.

An Exemplary Surface Mount Light Emitter

Figure 1:
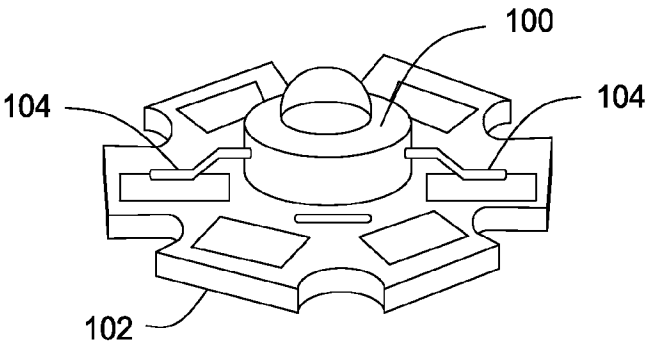
FIG. 1 (PRIOR ART)
FIG. 1 illustrates a prior art light-emitting diode (LED) requiring mounting on a heat sink to maintain an acceptable junction temperature of the LED.
Figure 2:
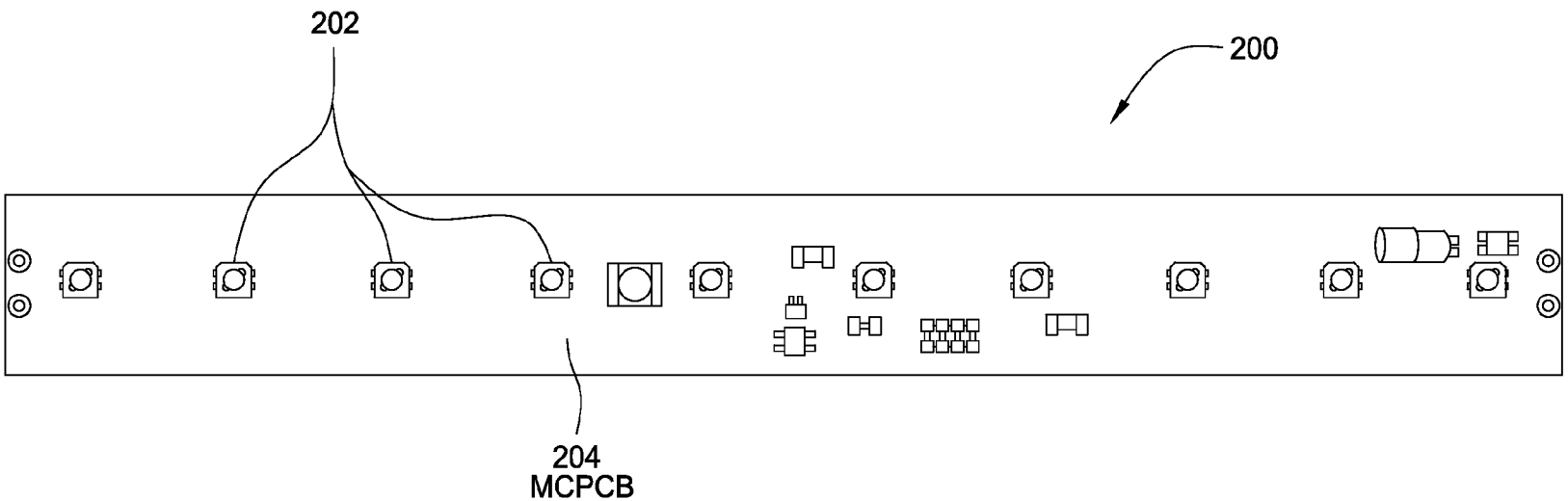
FIG. 2 (PRIOR ART)
FIG. 2 illustrates a prior art solid state light module comprising several surface mount LEDs soldered to a metal core printed circuit board (MCPCB) used as a heat sink to maintain acceptable junction temperatures of the LEDs.
Figure 3:
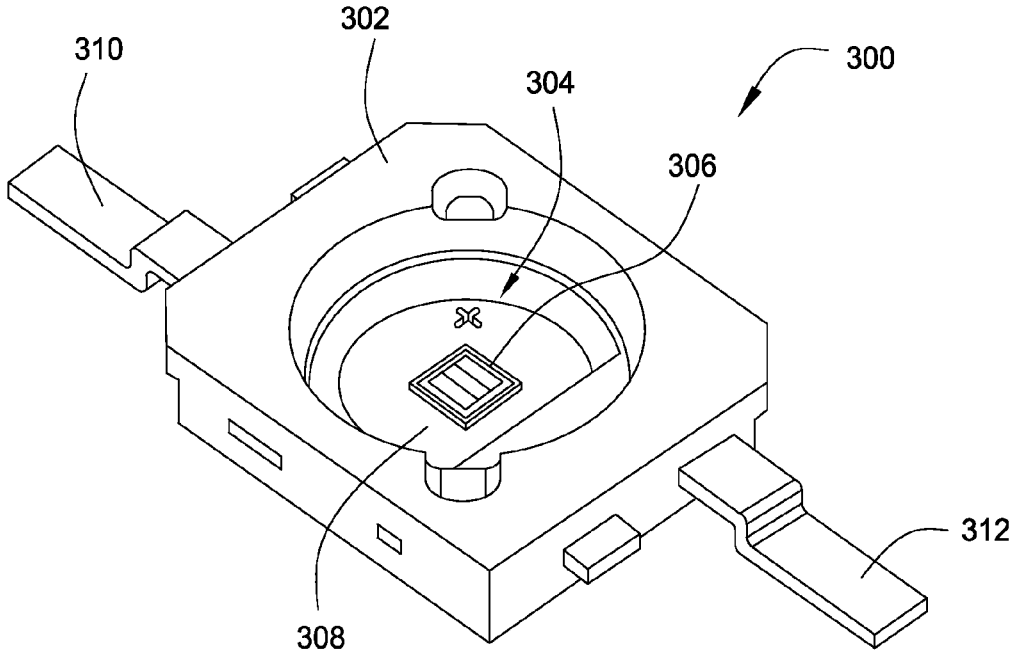
FIG. 3 is a three-dimensional (3-D) image of a surface mount solid state light emitter for use in an embodiment of the invention.

FIG. 3 is a three-dimensional (3-D) image of a surface mount solid state light emitter 300 for use in a solid state light module according to some embodiments of the invention. The light emitter 300 may incorporate a housing 302 with a recess 304. An LED die 306 having a metal substrate (not visible) may be disposed in the recess 304. The metal substrate may be composed of any suitable metal having a low thermal resistance, such as copper, a copper alloy, or a composite metal. The metal substrate of the LED die 306 may be thermally and electrically coupled to a lead frame 308 having two leads 310, 312 via a suitable electrical conductor with significant heat conduction properties, such as a metal bonding layer or a eutectic layer (not visible). For embodiments incorporating a metal bonding layer, metal alloys (e.g., Au—Sn, Ag—Sn, Ag—Sn—Cu, and Sn alloy) may be utilized. For other embodiments with a eutectic layer, materials—such as Sn, In, Pb, AuSn, CuSn, AgIn, CuIn, SnPb, SnInCu, SnAgIn, SnAg, SnZn, SnAgCu, SnZnBi, SnZnBiIn, and SnAgInCu—may couple the LED's metal substrate with the lead frame 308.

The use of a eutectic layer allows for eutectic bonds having high bonding strength and good stability at a low process temperature to form between the metal substrate or the lead frame and the eutectic layer during fabrication of the light emitter 300, as disclosed in commonly owned U.S. patent application Ser. No. 11/382,296, filed May 9, 2006, herein incorporated by reference. Also, eutectics have a high thermal conductivity and a low coefficient of thermal expansion, which may lead to a decreased overall thermal resistance between the LED die 306 and the ambient environment.

Those skilled in the art will recognize that the lead frame 308 may have two, three, four, or more leads for some embodiments, depending on the package and the amount of desired heat dissipation. Furthermore, more than one LED die 306 may be disposed in the recess 304, and the recess 304 may be at least partially filled or covered with light-enhancing devices or color-changing materials.

By having decreased thermal resistance between the LED die 306 and the lead frame 308 compared to typical solid state light emitters without a metal substrate or a bonding layer, the light emitter 300 may have a comparatively lower junction temperature. The lower junction temperature may provide for an increased lifetime and reliability of the light emitter 300. Moreover, the reduction in junction temperature may allow the emitter 300 to be employed in devices without a heat sink, potentially enabling the light emitter 300 to enter applications requiring diminished size or increased light intensity (since more light emitters 300 without a heat sink may fit in the same space of conventional solid state light emitters requiring a heat sink). Furthermore, the absence of a heat sink may avert damage to a printed circuit board (PCB) when the light emitter 300 described herein is employed, since damage to PCB pads and traces frequently occurs when trying to remove an electrical component soldered to a PCB and coupled to a large heat sink.

An Exemplary Through-Hole Light Emitter

Figure 4A:
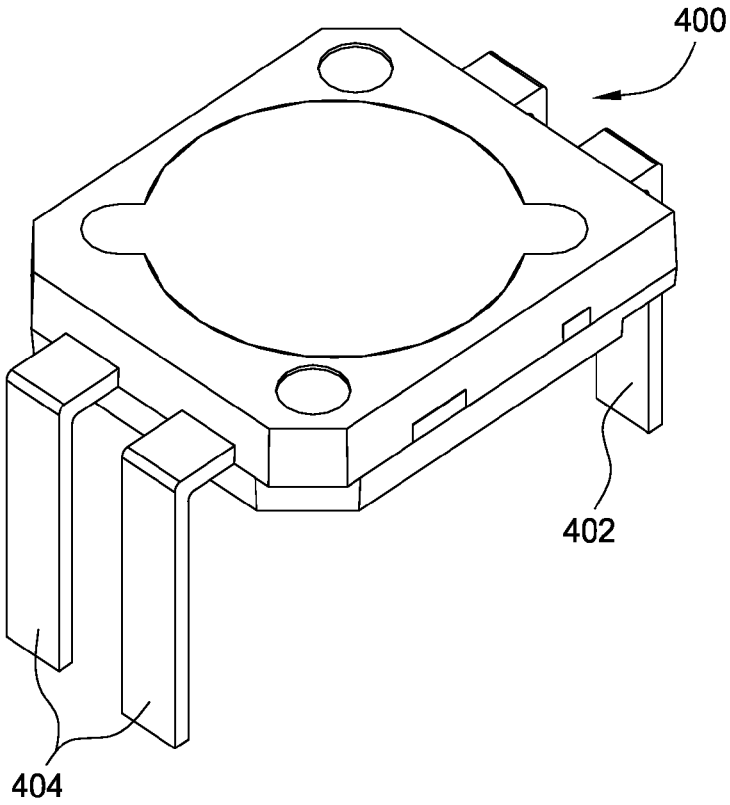
FIGS. 4A-B are a 3-D image and a top view of a through-hole solid state light emitter in accordance with an embodiment of the invention.
Figure 4B:
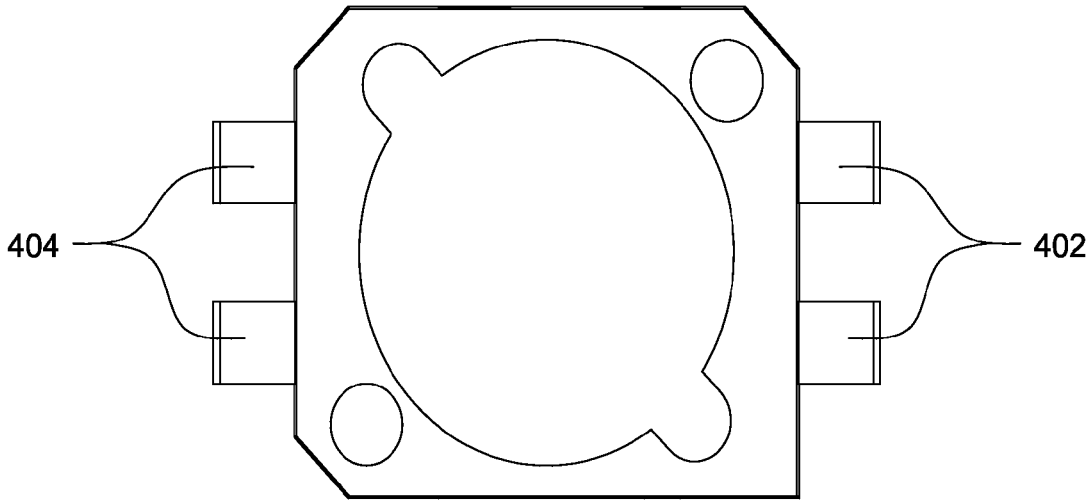

Another embodiment of a solid state light emitter is illustrated in the three-dimensional (3-D) and top views of FIGS. 4A-B. This through-hole solid state light emitter 400 may be similar in construction to the surface mount solid state light emitter 300 of FIG. 3 with one or more LED dies 306 disposed on a metal substrate. The metal substrate may be coupled to a through-hole lead frame having anode leads 402 and cathode leads 404 via a suitable electrical conductor with significant heat conduction properties, such as a metal bonding layer or a eutectic layer (not visible).

Figure 5A:
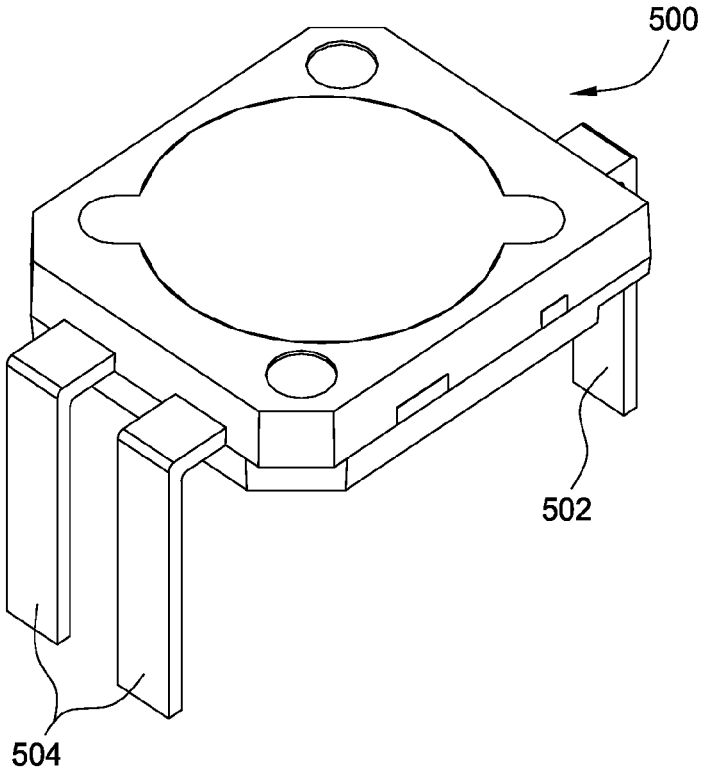
FIGS. 5A-B are a 3-D image and a top view of a through-hole solid state light emitter where the cathode and the anode possess asymmetrical pin configurations.
Figure 5B:
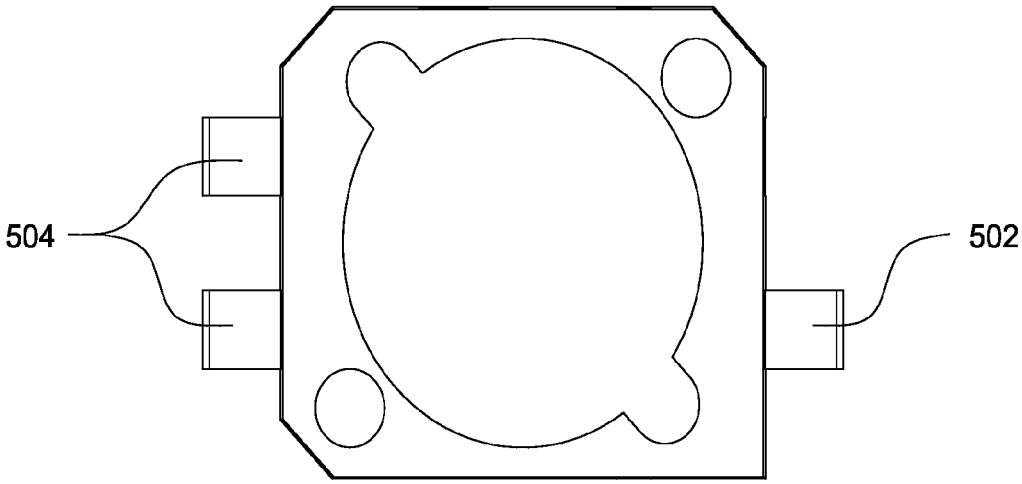

For some embodiments, as illustrated for the solid state light emitter 500 of FIGS. 5A-B, the number of anode leads 502 may be different than the number of cathode leads 504. This may help to differentiate the cathode side from the anode side, thereby providing a visual cue when plugging the solid state emitter 500 into a receptacle. For other embodiments, the size, shape, color, and/or markings of the anode leads may be different than those of the cathode leads to prevent improper insertion into the receptacle or at least indicate proper insertion. In such cases, the receptacle should be fabricated to correspond to the leads when properly inserted. Some embodiments may have a diode symbol represented on the package to denote the correct placement direction. Such cues may be characteristics of a solid state light emitter singly or in any combination.

Figure 6:
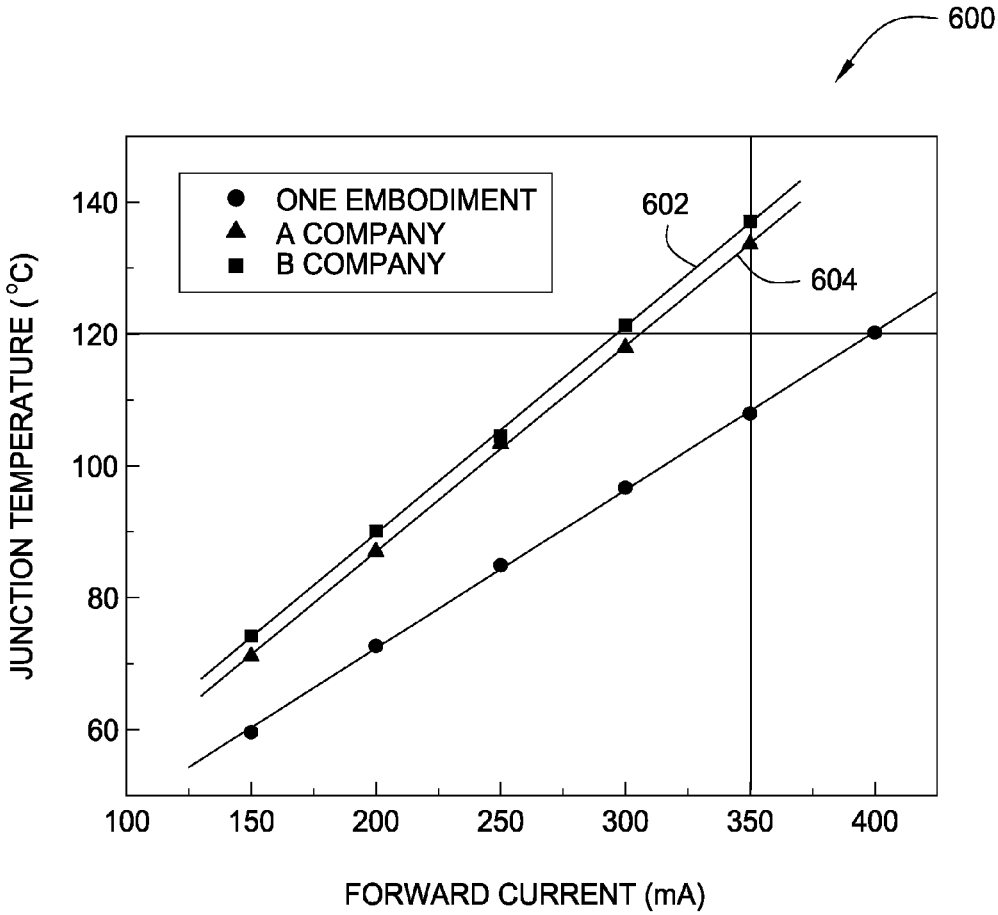
FIG. 6 is a graph of junction temperature versus forward current illustrating for two conventional solid state light emitters and a solid state light emitter in accordance with an embodiment of the invention.

By having decreased thermal resistance between the LED dies 306 and the through-hole lead frame compared to typical solid state light emitters without a metal substrate or a bonding layer, the through-hole light emitter 400 may also have a decreased junction temperature in relation to conventional light emitters. This property is depicted in the graph 600 of FIG. 6 characterizing steady-state junction temperature in degrees Celsius versus the applied forward current ($I_F$) in milliamps for two conventional solid state light emitters 602, 604 without heat sinks and the through-hole solid state light emitter 400 of FIG. 4, also without a heat sink. The conventional light emitters 602, 604 may use LED semiconductor layers deposited on a substrate of sapphire or silicon carbide (SiC), rather than the metal substrate of the solid state light emitter 400. The steady-state junction temperature of the solid state light emitter 400 according to embodiments of the invention may be significantly lower than the junction temperature of conventional solid state light emitters 602, 604, at least at forward currents that substantially raise the junction temperature of an LED die (e.g., above 100 mA).

Such a reduction in junction temperature may allow the through-hole solid state light emitter 400 to be employed in devices, such as light modules, without a heat sink, as described above for the surface mount light emitter 300. However, the through-hole light emitter 400 may have another advantage over conventional solid state light emitters: the optional use of a heat sink may allow the light emitter 400 to be electrically connected with the remainder of a device without the use of solder.

An Exemplary Solid State Light Module

For some embodiments, the solid state light emitters 300, 400, 500 described herein may be employed in light modules for use within a solid state lighting system. In such embodiments, the light modules may be designed to be interchangeable/replaceable.

Since the solid state light emitters 300, 400 do not require a heat sink to maintain the junction temperature within acceptable limits, the light module may utilize an interface capable of receiving the leads 310, 312, 402, 404 and holding the light emitter 300, 400 in place. For some embodiments, this interface may comprise a socket, a clip, a clamp, a mating connector, a screw terminal, or combinations thereof. For example, the solid state light emitter 400 may be inserted into a socket, which is further plugged into a screw terminal to make a right angle connection.

Figure 7A:
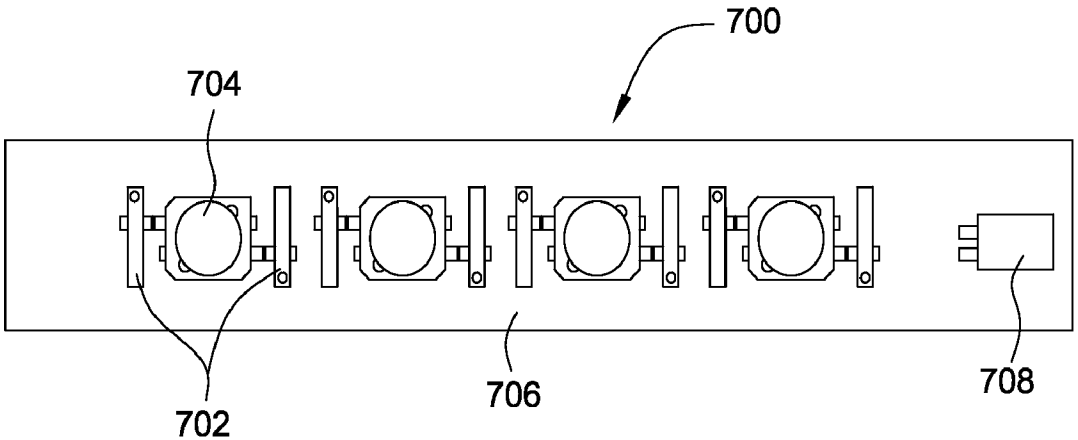
FIGS. 7A-B illustrate a top view and a side view of a solid state light module for use with the solid state light emitter of FIG. 3 in accordance with an embodiment of the invention.
Figure 7B:
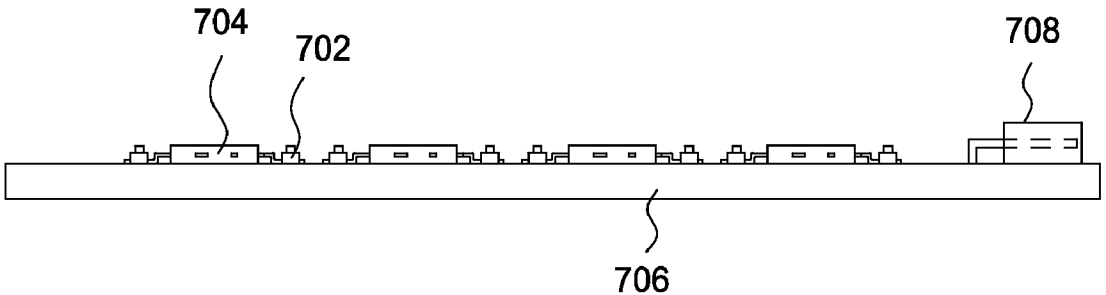

FIGS. 7A-B illustrate one embodiment of a solid state light module 700 for use with the surface mount solid state light emitter 300 of FIG. 3. The module 700 may comprise a PCB 706 having a driving circuit (not shown) or a connection to external circuitry for providing forward current to the light emitters 704 without the need for solder. Clips 702 may provide enough mechanical force to hold the light emitters 704 in place, but may allow the emitters 704 to be easily removed without solder. For some embodiments, the clips 702 may be conductive and provide an electrical path between the PCB 706 and the solid state light emitters 704. For other embodiments, conductive or insulative clips may force the leads of the emitters 704 into exposed pads of the PCB 706 for electrical contact.

To bias the solid state light emitters 704, the forward current may be at least 100 mA. For some embodiments, the solid state light module 700 may include a connector 708 to accept electrical power from a power supply and deliver it to the light emitters 704 directly. For other embodiments, the driving circuit may accept input AC or DC power received from the connector 708 and convert it to usable AC or DC power. To accomplish this, the driving circuit may include an AC-AC converter, an AC-DC converter, a DC-DC converter, or any combination of these. The driving circuit may also convert voltage to current, and the output of the driving circuit (i.e., the input to the light emitters 704) may be current limited.

Figure 8A:
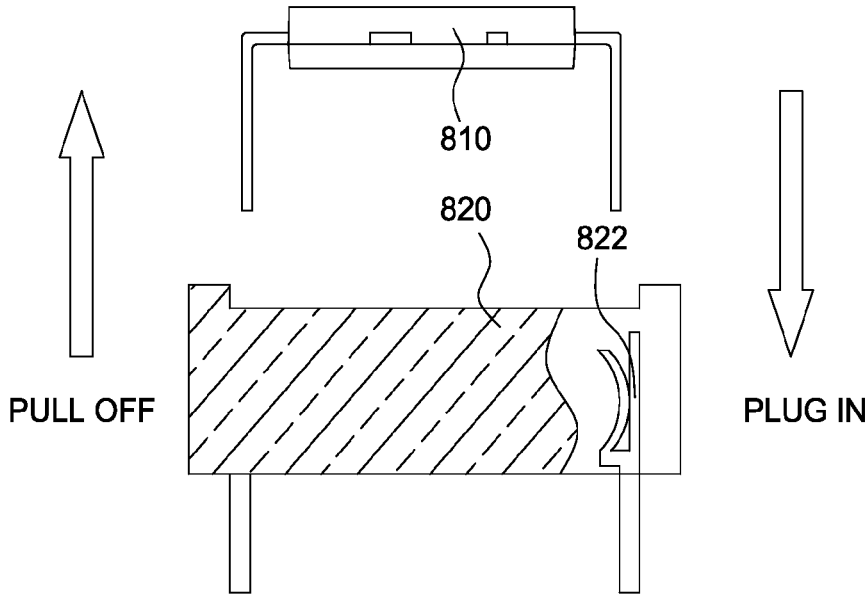
FIG. 8A and FIG. 8B illustrate side views of a through-hole socket and a surface mount socket, respectively, for use with the solid state light emitter of FIG. 4 in accordance with embodiments of the invention.
Figure 8B:
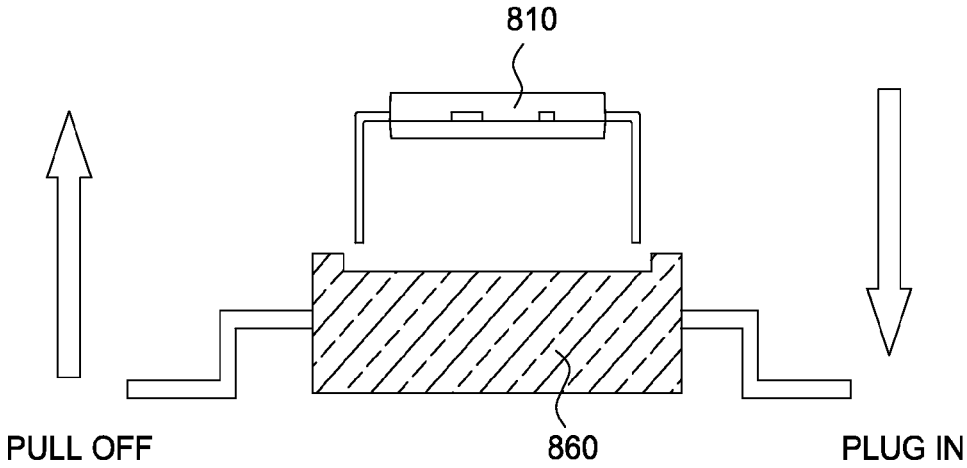

For the through-hole solid state light emitter 400 of FIG. 4, a different interface to the PCB of a solid state light module other than the clips 702 of FIGS. 7A-B may be desired. As an example, FIG. 8A illustrates a through-hole solid state light emitter 810 and a through-hole socket 820 which may be utilized in a solid state light module. The through-hole socket 820 may have terminals 822 for receiving leads of the solid state light emitter 810. For some embodiments, a surface mount socket 860 may be used with the through-hole solid state light emitter 810. The light emitter 810 may be plugged into or pulled off the sockets 820, 860 to make the electrical connection or disconnection, respectively.

Figure 8C:
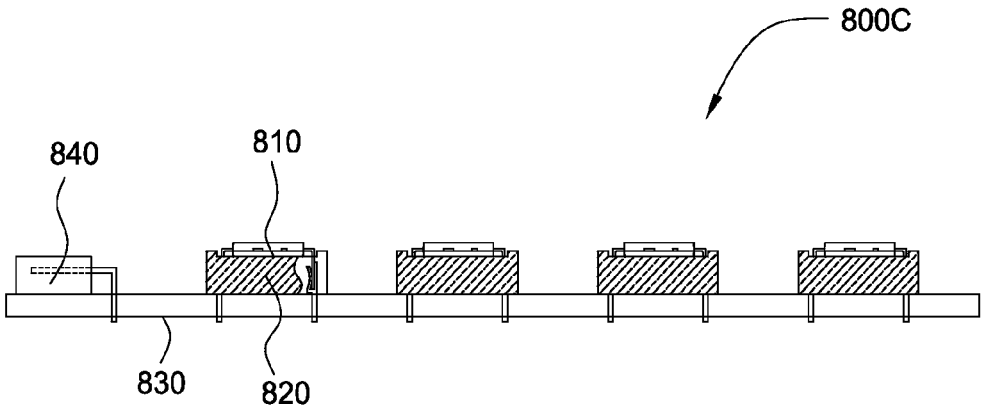
FIG. 8C and FIG. 8D illustrate side views of a solid state light module for use with the solid state light emitter of FIG. 4 and the sockets of FIG. 8A and FIG. 8B, respectively, in accordance with embodiments of the invention.
Figure 8D:
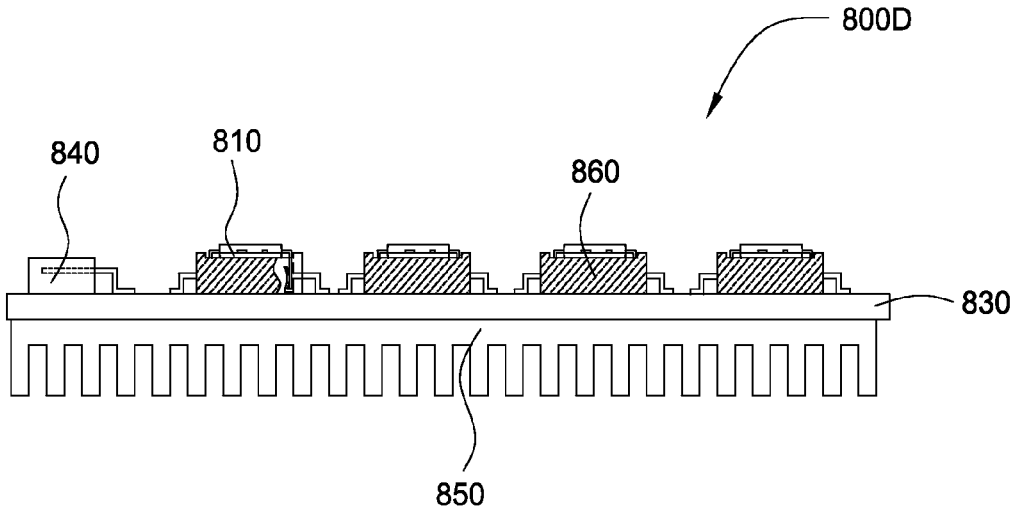
Figure 8E:
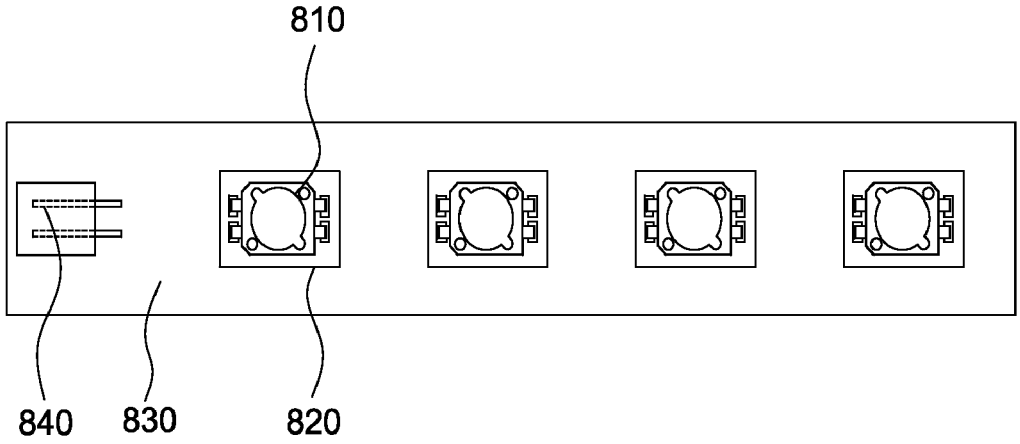
FIG. 8E illustrates a top view of the solid state light module of FIG. 8C in accordance with an embodiment of the invention.

An exemplary utilization of such sockets 820, 860 is shown in the solid state light modules 800*c*, 800*d* of FIGS. 8C-D. As illustrated in the side view of FIG. 8C and the top view of FIG. 8E, the through-hole sockets may be coupled to a PCB 830 via solder, and the solid state light emitters 810 may be mechanically plugged into the sockets 820 to make electrical contact. An electrical connector 840 may accept external power, and for some embodiments, a driving circuit (not shown) may convert the received power into a form usable by the light emitters 810. FIG. 8D illustrates the use of the surface mount sockets 860 in a solid state light module 800*d*. For some embodiments, a heat sink 850 may be attached to the back side of the PCB 830 in an effort to dissipate heat away from the light emitters 810.

Figure 9A:
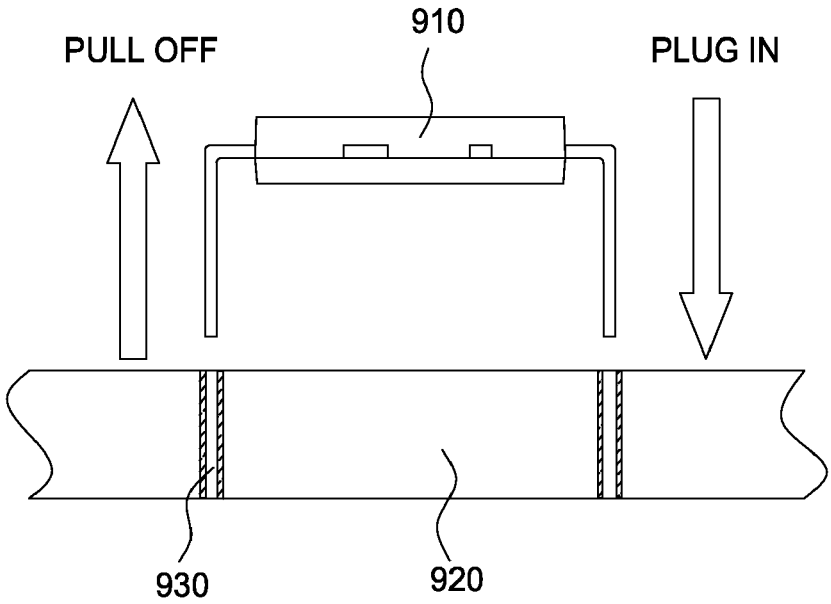
FIG. 9A illustrates a side view of a printed circuit board (PCB) with vias for receiving the leads of the solid state light emitter of FIG. 4 in accordance with an embodiment of the invention.
Figure 9B:
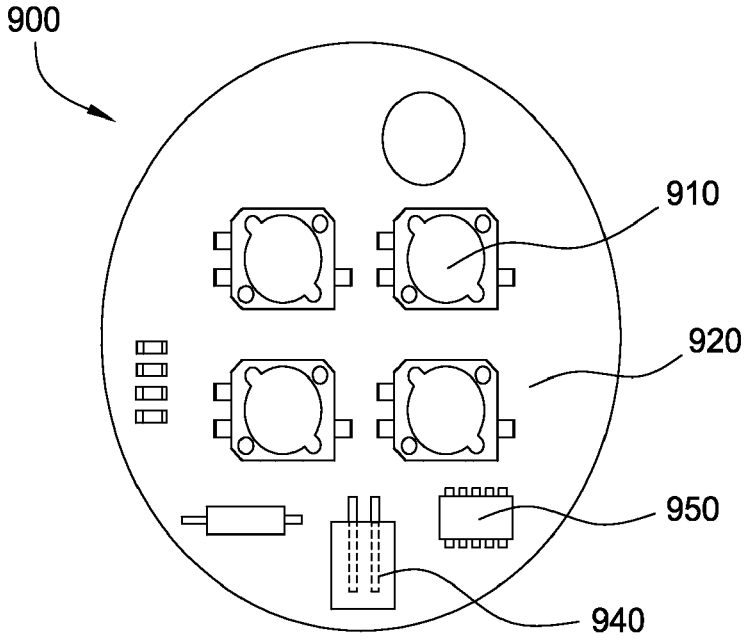
FIG. 9B illustrates a top view of a solid state light module for use with the PCB and solid state light emitter of FIG. 9A in accordance with an embodiment of the invention.

Referring now to FIG. 9A, rather than a socket or other type of receptacle, some embodiments of solid state light modules may allow for the direct connection of a solid state light emitter 910 to metal vias 930 in a PCB 920. The emitter 910 may be plugged into or pulled out of the metal vias 930 for electrical connection or disconnection, respectively. As illustrated in FIG. 9B, a connector 940 may accept electrical power from an external power supply. For some embodiments, a driving circuit or integrated circuit (IC) 950 may be coupled to the connector 940 and configured to provide current to the solid state light emitters 910.

By utilizing an interface between the light emitter and the light module's PCB, a light emitter may be easily replaced in the field if the emitter fails or a different light emitter is desired, for example, for a different color, an upgraded version with increased intensity, or a different emission pattern. There should be no need to return the module to the factory or replace the entire module if other components besides the light emitter are still functional. In fact, the ability to quickly remove a suspected "bad" emitter and install a known-good light emitter by hand may allow a customer or the manufacturing facility to determine whether the light emitter or something else, such as the driving circuit is responsible for an improperly functioning module. Furthermore, since no soldering or desoldering is required to remove the light emitter from the module, the risk of damage to the module during an emitter-replacement operation may be significantly reduced. All of these may serve to save the customer and/or the manufacturer time and/or expense.

Figure 10:
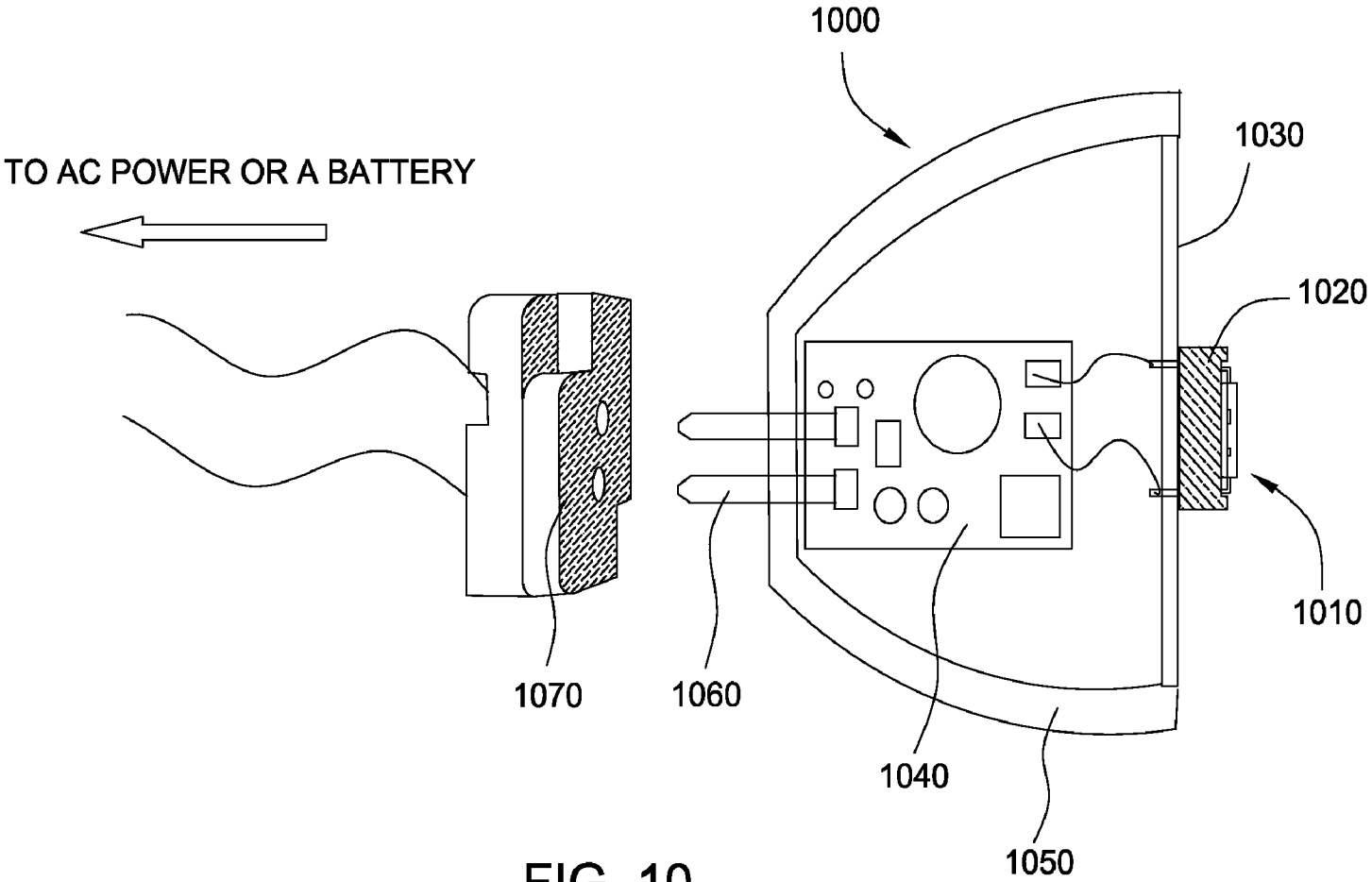
FIG. 10 illustrates a GX5.3/GU5.3-compatible lamp base as the interface between a solid state light module and a power source in accordance with an embodiment of the invention.

FIG. 10 illustrates an exemplary embodiment of a solid state light module 1000 and a module socket 1070. The module socket 1070 may be configured to accept the external connections, such as pins, leads, or prongs 804, of the light module 1000 to make electrical contact between the two components 1000, 1070. The module socket 1070 may be any suitable socket for receiving the prongs 1060 and supplying the rated current and voltage to the light module 1000 from an AC or DC power supply (not shown) of a solid state lighting system. For example, the module socket 1070 may be a GX5.3/GU5.3 socket (for supplying 24 V or 12 V DC from a car battery and interfacing with MR-16 plugs as shown in FIG. 10) or another type of socket for supplying 120 V AC from an electrical wall outlet in the United States. The power supply may be connected with one or more module sockets 1070 via wires or cables sufficiently rated for the current capacity of the solid state lighting system.

Returning to the light module 1000, a driving circuit 1040 as described herein may be integrated on a PCB connected with the prongs 1060. The driving circuit 1040 may be coupled to the prongs 1060 and receive input power from the power supply when the light module 1000 is plugged into the module socket 1070. The driving circuit 1040 may convert this received input power to provide acceptable current levels to the solid state light emitters 1010. For instance, the driving circuit 1040 may convert received 120 V AC power to DC power with a reduced voltage level. Other types of converters for the driving circuit 1040 are described above.

The light emitters 1010 may be coupled to the driving circuit 1040 via an emitter interface 1020. Some embodiments of a light module may provide more than one emitter interface 1020. The emitter interface 1020 may be, for example, a socket, a clamp, a clip, a screw terminal, a mating connector, or combinations thereof. FIG. 10 depicts one solid state light emitter 1010 (which may be the same or similar to the emitter 400 of FIG. 4) although those skilled in the art will acknowledge that more than one solid state light emitter 1010 may be connected to a single emitter interface 1020. FIG. 10 also illustrates how these light emitters 1010 may be connected and disconnected with the emitter interface 1020 through the application of mechanical force, such as pushing/pulling shown here. Depending on the type of emitter interface 1020, other mechanical forces may include clipping/unclipping, clamping/unclamping, plugging/unplugging, locking/unlocking, twisting/untwisting, and coupling/uncoupling.

For the illustrated embodiments, no solder is required to connect the solid state light emitters 1010 with the emitter interface 1020, an advantage for efficient field replacement of light emitters 1010. In addition, such relatively easy removal and installation of light emitters 1010, when compared to conventional LED emitters, may allow for quicker upgrades to a light module 1000 by replacing the light emitters 1010 with more efficient or increased intensity light emitters, for example. Light modules may be easily customized or suited to match an application by replacing the light emitters 1010 with solid state light emitters possessing a different emission pattern or emitting a different color of light. Having an emitter interface with multiple positions for installing emitters may also permit a user to create various desired shapes or patterns by pushing in or pulling out certain emitters of a given light module 1000. Such upgrades or customizations may be performed manually by customers in the field, at the manufacturing facility, or by a third party vendor.

Light modules as described herein may be very adaptable. For example, the light module 1000 may be adapted to fit just about any module socket 1070 since the driving circuit 1040 is on a PCB separate from the socket 1070 and the PCB can be configured in various shapes and sizes depending on the application. As another example of this configurability, screw base adapters are available for MR-16 plugs.

Figure 11A:
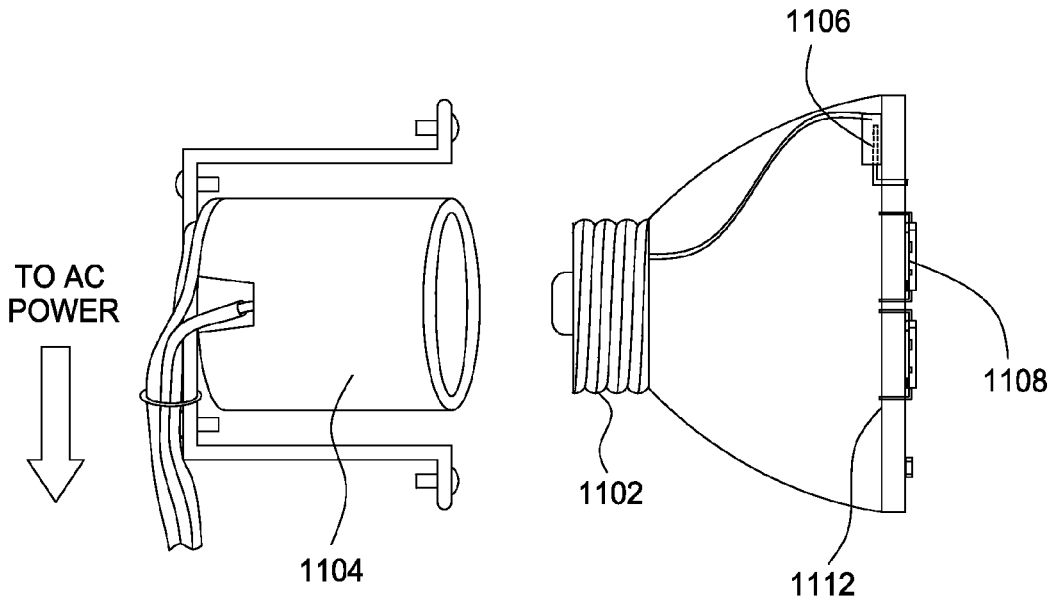
FIGS. 11A-B illustrate an Edison screw base as the interface between a solid state light module and a power source in accordance with an embodiment of the invention.
Figure 11B:
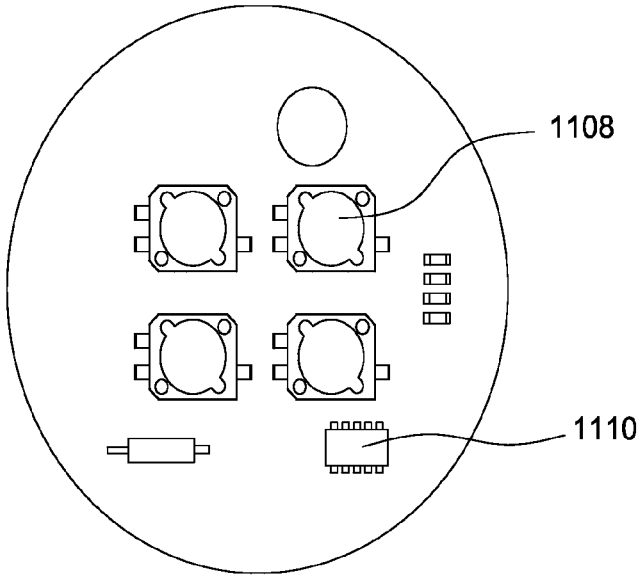

For some embodiments, a solid state lighting system may utilize such a screw base adapter connected with, for example, the light module 1100 of FIGS. 11A-B to present a standard Edison screw base 1102 (e.g., E12, E17, E26, and E39) to a standard threaded socket, such as the mogul base porcelain socket 1104 shown. In this manner, solid state light modules described herein may replace incandescent, halogen, or fluorescent light bulbs in some applications. Furthermore, the emitter interface 1112 may be adapted to take various shapes or accept any reasonable number of light emitters 1108. To further increase the flexibility, combinations of emitter interfaces 1112 may be construed to create various light extraction angles and various shapes for the light module 1100.

While the foregoing is directed to embodiments of the present invention, other and further embodiments of the invention may be devised without departing from the basic scope thereof, and the scope thereof is determined by the claims that follow.

The invention claimed is:

1. A solid state light module comprising:

a printed circuit board (PCB);

at least one light-emitting diode (LED), wherein the LED is coupled to the PCB via a solderless connection, the PCB having a driving circuit for providing a current to the LED, wherein the current provided to the LED is at least 100 mA, wherein the LED comprises a semiconductor structure for emitting light coupled to a metal substrate; and a first interface coupled to the PCB, for external connection with a power supply.

2. The solid state light module of claim 1, wherein the driving circuit comprises an AC-AC converter, an AC-DC converter, a DC-DC converter, or combinations thereof.

3. The solid state light module of claim 1, wherein the driving circuit comprises a voltage to current converter.

4. The solid state light module of claim 1, wherein the driving circuit comprises a current limiter.

5. The solid state light module of claim 1, further comprising a second interface between the PCB and the at least one LED configured such that leads of the LED are electrically connected with the second interface by mechanical force.

6. The solid state light module of claim 5, wherein the second interface comprises at least one of a socket, a clip, a clamp, a screw terminal, and a mating connector.

7. The solid state light module of claim 5, wherein the second interface comprises a socket having at least two receptacles, wherein at least one of the receptacles has a different shape, size, color, or markings than at least another of the receptacles.

8. The solid state light module of claim 5, wherein the second interface is coupled to a heat sink.

9. The solid state light module of claim 1, wherein the at least one LED further comprises a lead frame coupled to the metal substrate via a metal bonding layer and/or a eutectic layer.

10. The solid state light module of claim 9, wherein the metal bonding layer comprises at least one of Au—Sn, Ag—Sn, Ag—Sn—Cu, and a Sn alloy.

11. The solid state light module of claim 9, wherein the eutectic bonding layer comprises at least one of Sn, In, Pb, AuSn, CuSn, AgIn, CuIn, SnPb, SnInCu, SnAgIn, SnAg, SnZn, SnAgCu, SnZnBi, SnZnBiIn, and SnAgInCu.

12. The solid state light module of claim 1, wherein the metal substrate comprises at least one of copper, copper alloy, and a composite metal.

13. The solid state light module of claim 1, wherein the at least one LED comprises one or more anode leads and one or more cathode leads, wherein at least one of the anode leads has a different shape, size, color, or markings than at least one of the cathode leads.

14. The solid state light module of claim 1, wherein the at least one LED comprises a first number of anode leads and a second number of cathode leads, wherein the first number is different than the second number.

15. The solid state light module of claim 1, wherein the at least one LED is coupled to a heat sink.

16. A solid state lighting system, comprising:

a power supply coupled to one or more module interfaces, wherein the module interfaces comprise at least one of a GX5.3 socket, a GU5.3 socket, and a threaded socket; and one or more solid state light modules, each module at least mechanically and electrically coupled to one of the module interfaces, wherein each of the solid state light modules comprises:

a printed circuit board (PCB);

at least one light-emitting diode (LED), wherein the LED is coupled to the PCB via a solderless connection, the PCB having a driving circuit for providing a current to the LED, wherein the current provided to the LED is at least 100 mA; and a first interface coupled to the PCB, for connection with one of the module interfaces.

17. The solid state lighting system of claim 16, wherein the power supply comprises AC power or a battery.

18. The solid state lighting system of claim 16, further comprising a second interface between the PCB and the at least one LED for each of the one or more solid state light modules, the second interface configured such that leads of the at least one LED are electrically connected with the second interface by mechanical force.

19. The solid state lighting system of claim 18, wherein the second interface comprises at least one of a socket, a clip, a clamp, a screw terminal, and a mating connector.

20. The solid state lighting system of claim 16, wherein the at least one LED for each of the one or more modules comprises a semiconductor structure for emitting light coupled to a metal substrate.

21. A solid state lighting system comprising:

a power supply; and one or more solid state light modules, each module comprising:

a light source printed circuit board (PCB);

at least one light-emitting diode (LED), wherein the LED is coupled to the light source PCB without solder;

a circuit module coupled to the light source PCB via a first interface;

a driving circuit disposed on the circuit module for providing current to the at least one LED, wherein the current is at least 100 mA;

a second interface disposed on the circuit module and coupling the power supply to the circuit module; and a third interface between the light source PCB and the at least one LED for each of the solid state light modules, the third interface configured such that leads of the at least one LED are electrically connected with the third interface by mechanical force.

22. The solid state lighting system of claim 21, wherein the power supply comprises AC power or a battery.

23. The solid state lighting system of claim 21, wherein the third interface comprises at least one of a socket, a clip, a clamp, a screw terminal, and a mating connector.

24. A method of replacing a first light-emitting diode (LED) in a solid state light module with a second LED, the method comprising:

providing the solid state light module comprising:

a printed circuit board (PCB);

a first interface coupled to the PCB, for external connection with a power supply; and the first LED, wherein the first LED is coupled to the PCB via a second interface configured such that leads of the first LED are at least electrically and mechanically coupled to the second interface without solder;

applying a first mechanical force to remove the first LED from the second interface;

providing the second LED; and applying a second mechanical force to install the second LED such that an electrical contact is made between the second interface and the second LED, wherein a current provided to the first or the second LED is at least 100 mA.

25. The method of claim 24, wherein the first LED or the second LED comprises a semiconductor structure for emitting light coupled to a first metal substrate.

26. The method of claim 24, wherein applying the first mechanical force comprises at least one of pulling, unclamping, unclipping, uncoupling, unlocking, and untwisting.

27. The method of claim 24, wherein applying the second mechanical force comprises at least one of pushing, inserting, clamping, clipping, coupling, locking, and twisting.

28. The solid state light module of claim 1, wherein the at least one LED comprises one or more anode leads and one or more cathode leads, wherein the driving circuit of the PCB is connected with at least one of the anode leads and with at least one of the cathode leads.

* * * * *